US006923324B2

(12) United States Patent
Kanai

(10) Patent No.: US 6,923,324 B2
(45) Date of Patent: Aug. 2, 2005

(54) PACKAGING SYSTEM

(75) Inventor: Masahiro Kanai, El Paso, TX (US)

(73) Assignee: Seiko Epson Corporation, Tokyo (JP)

( * ) Notice: Subject to any disclaimer, the term of this patent is extended or adjusted under 35 U.S.C. 154(b) by 141 days.

(21) Appl. No.: 10/346,756

(22) Filed: Jan. 17, 2003

(65) Prior Publication Data

US 2003/0213717 A1 Nov. 20, 2003

Related U.S. Application Data

(60) Provisional application No. 60/381,442, filed on May 17, 2002.

(51) Int. Cl.[7] ..... B65D 71/00
(52) U.S. Cl. ..... 206/497
(58) Field of Search ..... 206/497, 223, 206/583, 495, 478

(56) References Cited

U.S. PATENT DOCUMENTS

| | | | | | |
|---|---|---|---|---|---|
| 2,837,208 | A | | 6/1958 | Lingenfelter | |
| 3,669,337 | A | | 6/1972 | Struble | |
| 4,865,200 | A | | 9/1989 | Sullivan et al. | |
| 5,044,495 | A | * | 9/1991 | Wyslotsky | 206/315.9 |
| 5,226,542 | A | | 7/1993 | Boecker et al. | |
| 5,323,896 | A | | 6/1994 | Jones | |
| 5,676,245 | A | | 10/1997 | Jones | |
| 5,797,493 | A | * | 8/1998 | Watson | 206/443 |
| 5,887,717 | A | * | 3/1999 | Anderson et al. | 206/460 |
| RE36,412 | E | | 11/1999 | Jones | |
| 6,010,003 | A | * | 1/2000 | Wilkinson | 206/478 |
| 6,047,831 | A | | 4/2000 | Jones | |
| 6,073,761 | A | * | 6/2000 | Jones | 206/223 |
| 6,223,901 | B1 | | 5/2001 | Lofgren et al. | |
| 6,311,843 | B1 | | 11/2001 | Smith et al. | |
| 6,311,844 | B1 | | 11/2001 | Ridgeway et al. | |

* cited by examiner

*Primary Examiner*—Jacob K. Ackun, Jr.
(74) *Attorney, Agent, or Firm*—Mark P. Watson

(57) ABSTRACT

A packaging system that protects an article. The packaging system includes a corrugated paperboard cradle having a flat, rigid support portion for supporting a lower surface of the article and a tubular plastic sleeve having a tubular axis. The sleeve surrounds the article and at least a portion of the support portion to secure the article to the cradle. The sleeve is heat shrunk to conform to the upper periphery of the upper surface of the article, to form a package assembly. The cradle is placed in a universal presentation box for shipping.

12 Claims, 5 Drawing Sheets

PACKAGING SYSTEM

This application claims the benefit of the provisional application Ser. No. 60/381,442, filed May 17, 2002, entitled Method and Apparatus For Packaging Lightweight Objects, which is incorporated by reference in its entirety.

FIELD OF THE INVENTION

The present invention relates to packaging systems for protecting articles during shipping.

BACKGROUND OF THE INVENTION

When shipping an article it is important to protect the article against shocks and vibrations that are often difficult to predict. At the same time, it is important to minimize the costs of the shipping materials, and to use materials that are environmentally friendly, such as recyclable and reusable materials.

A wide variety of techniques have been used to package articles in an attempt to secure the articles to prevent excess movement and cushion the articles from shocks. These techniques include the placement of polymer foam forms around the article, surrounding the article with a corrugated paper board structure, fastening the article to a corrugated paper board structure, and other methods. These techniques suffer from a variety of problems including packages that are difficult to open and difficult to dispose of, packages that inadequately protect the article, packages that are expensive because they require a large amount of materials, and packages that require the use of non-recyclable materials. In addition, many of these techniques do not accommodate articles having a wide variety of shapes and sizes.

U.S. Pat. No. 4,865,200 (the '200 patent) to Sullivan discloses a shipping container for transporting fragile articles. The shipping container consists of a support member and a carton dimensioned to permit insertion of the support member. The support member has a surface face upon which the fragile article is fixed, preferably by adjustable flaps folded over and secured around the article by straps. Some disadvantages of the shipping container are that folding the flaps and attaching straps to secure the article to the support member is labor and material intensive. Where the folds are preformed, manufacturing cost is also increased.

U.S. Patent Application No. RE 36,412 (the '412 patent) to Jones discloses an article packaging kit. The kit comprises a stiff sheet material, such as, for example paper or corrugated cardboard sheet material of defined width and length. The sheet material has a base portion generally dimensioned to hold an article to be packaged and immobilized, and end portions on opposite sides of the base portion. The end portions are adapted to be folded generally perpendicularly upwardly from the base portion and at either end of the base portion. The sheet material has a horizontal fold line, typically centrally disposed, which generally extends substantially along its length, but which may include more than one fold line to permit the sheet material to move between a first, generally flat position and a second, foldable article insertion position. The sheet material includes first and second spaced-apart, generally substantially parallel, vertical fold lines to define the end portions and to permit the end portions to move between a generally planar flat position and an upwardly folded position when the article is immobilized. Upward movement of the end portions on the vertical fold lines causes the horizontal fold line to flatten out, which in turn causes the sleeve or tube to stretch over the article being packaged.

As for the shipping container disclosed in the '412 patent, the fold lines and the folding required to package the article increase both manufacturing and labor costs.

Therefore, there is a need for a packaging system that is effective to securely package an article while protecting the article from damage due to shock, while reducing manufacturing, labor, and material costs.

SUMMARY OF THE INVENTION

Within the scope of the invention, a packaging system is disclosed for protecting an article. The disclosed packaging system includes a corrugated paperboard cradle having a flat, rigid support portion for supporting a lower surface of the article and a tubular plastic sleeve defining a tubular axis. The sleeve surrounds the article and at least a portion of the support portion to secure the article to the cradle. The support portion extends beyond the lower surface of the article in two opposite directions perpendicular to the tubular axis and the sleeve extends beyond the article in two opposite directions parallel to the tubular axis. The sleeve is heat shrunk to conform to the upper periphery of the upper surface of the article to form a package assembly. The cradle may be placed in a universal presentation box for shipping.

Additional features and advantages of the present invention will be more readily understood upon consideration of the following detailed description of the invention, taken in conjunction with the following drawings.

DETAILED DESCRIPTION OF THE PREFERRED EMBODIMENT

Figure 1:
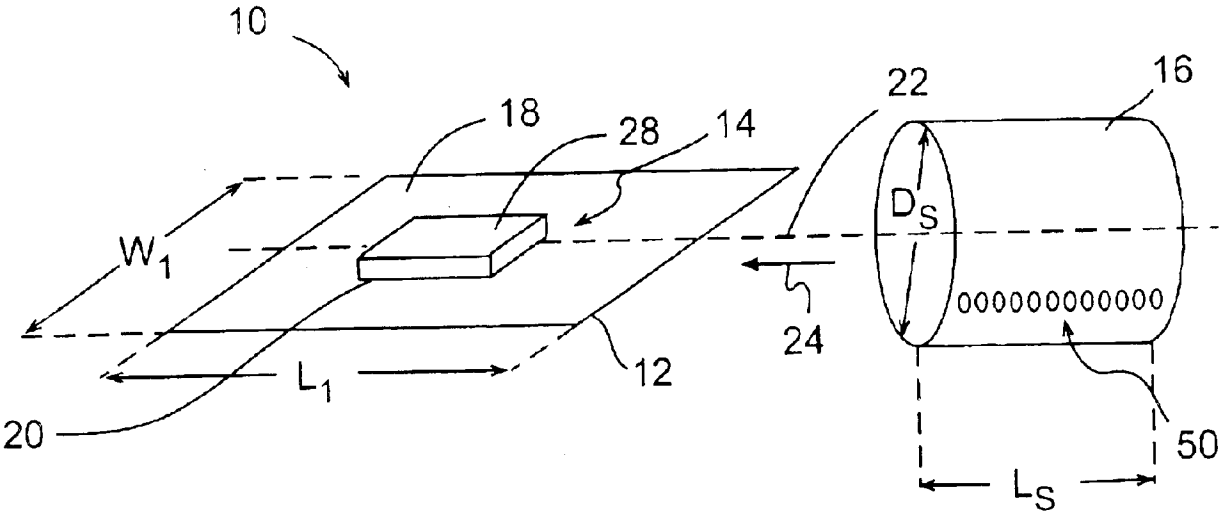
FIG. 1 is a pictorial view of a packaging system according to the present invention showing a cradle for supporting an article and a heat shrinkable sleeve.
Figure 9:
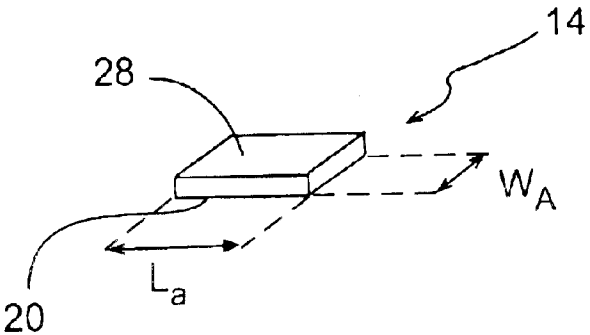
FIG. 9 is a pictorial view of the article of FIG. 1.

A packaging system 10 according to the present invention is shown in FIG. 1. The packaging system includes a cradle 12 onto which an article 14 is secured by means of a heat shrinkable sleeve 16. The cradle 12 includes a flat support portion 18 for supporting a lower surface 20 of the article 14. The flat support portion 18 has a length $L_1$ and a width $W_1$. The length $L_1$ is greater than a corresponding length $L_a$ of the article 14 (see FIG. 9), and the width $W_1$ is greater than a corresponding width $W_a$ of the article.

The sleeve 16 is provided of heat shrinkable plastic material, such as PETG (polyester glycol) in a tubular configuration defining a tubular axis 22. The sleeve has a length $L_s$ in the direction of the tubular axis that is less than the length $L_1$ of the support portion 18. The sleeve also has a diameter $D_s$ that is large enough so that the sleeve may loosely surround the support portion and the article 14. The sleeve is disposed around the cradle 12 and the article 14 by being moved in the direction of the arrow 24, into the position shown in FIG. 2 wherein, preferably, the article 14 is substantially centered in the sleeve.

Figure 2:
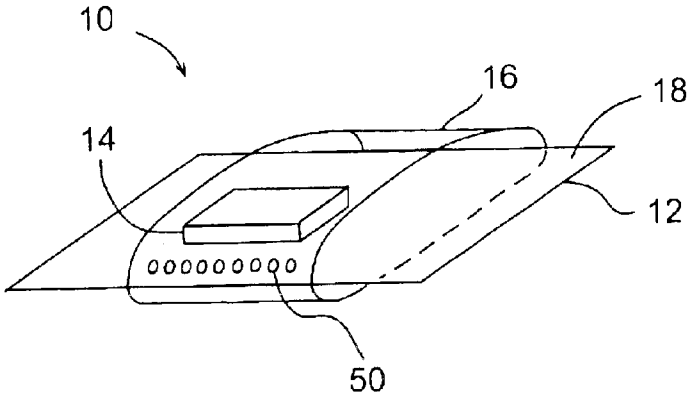
FIG. 2 is a pictorial view of the packaging system of FIG. 1 after the sleeve has been loosely placed around the cradle and the article.
Figure 3:
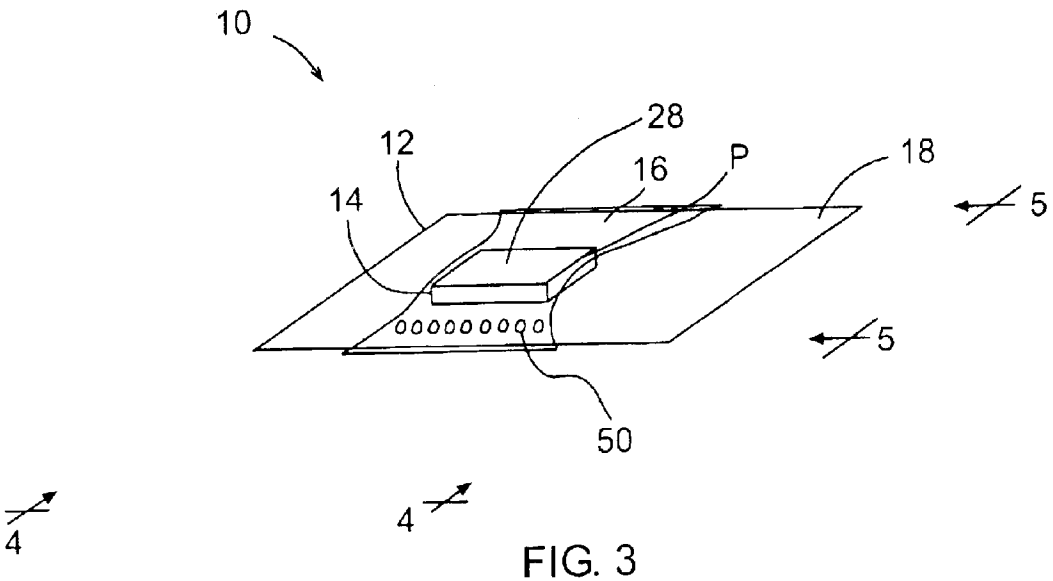
FIG. 3 is a pictorial view of the packaging system of FIG. 1 after the sleeve has been heat shrunk over the cradle and the article.

FIG. 3 shows the packaging system 10 of FIG. 2 after heat has been applied to the sleeve to heat shrink the sleeve so that it snugly contracts around the support portion 18 and the article 14. The article has an upper surface 28 having an outer periphery "P" to which the sleeve conforms by contracting around the edge defined by the periphery "P."

Figure 4:
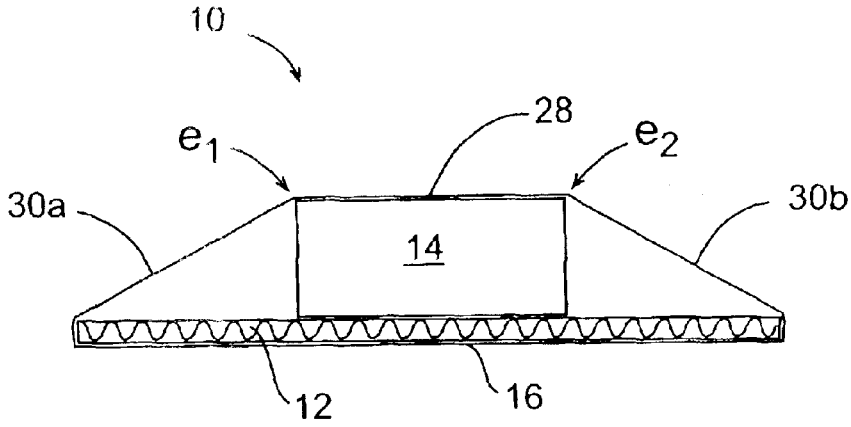
FIG. 4 is a cross-sectional view of the packaging system of FIG. 3 taken along the line 4—4.

FIG. 4 shows a cross-section of the packaging system of FIG. 3 taken along a line 4—4 that is perpendicular to the tubular axis 22. The sleeve conforms to the edges $e_1$ and $e_2$ of the periphery "P" of the upper surface of the article 14 as a result of being pulled tight by portions 30*a* and 30*b*.

Figure 5:
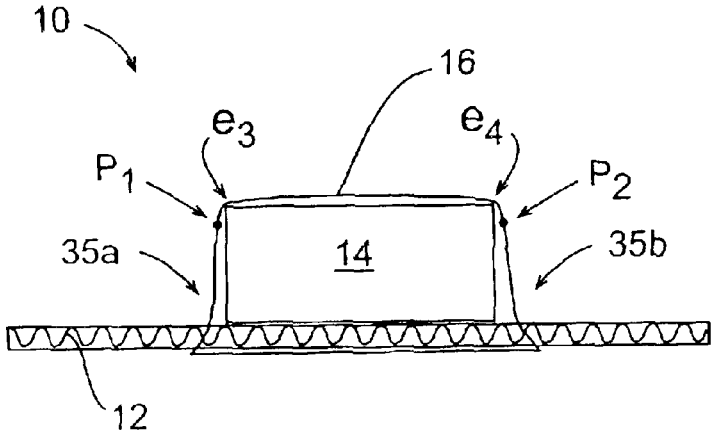
FIG. 5 is a cross-sectional view of the packaging system of FIG. 3 taken along the line 5—5.
Figure 6:
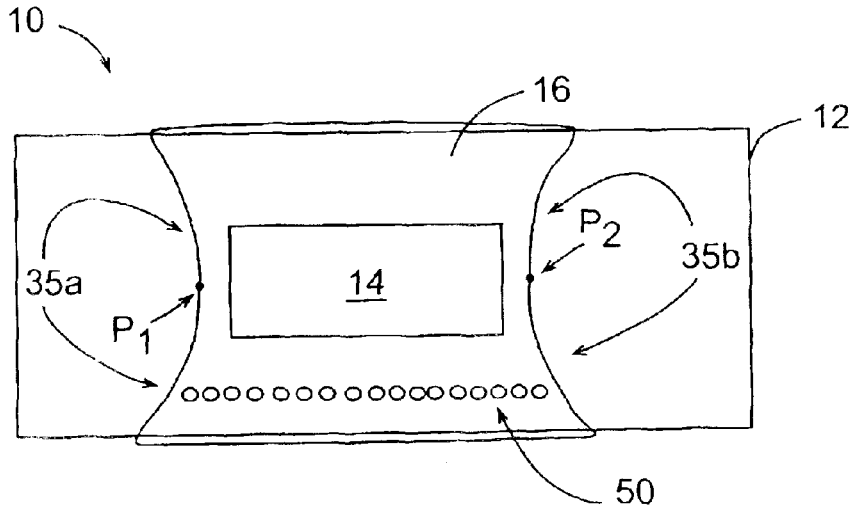
FIG. 6 is a plan view of the packaging system of FIG. 3.

Similarly, FIG. 5 shows a cross-section of the packaging system of FIG. 3 taken along a line 5—5 that is parallel to the tubular axis 22. With additional reference to FIG. 6 showing a plan view of the packaging system of FIG. 3, heat shrinking the sleeve causes the sleeve to conform to edges $e_3$ and $e_4$ of the periphery "P" of the article. Particularly, shrunken portions 35*a* and 35*b* of the sleeve pull points P1 and P2 toward the support portion.

An outstanding feature of the invention is that the corrugated paperboard, support portion 18 is provided with no creases, folds, or score lines and has not otherwise been weakened in any other manner so that it is both flat and "rigid," as the term is used herein.

In this regard, it may be noted that an additional undesirable characteristic of the article packaging kit disclosed in the '412 patent is recognized herein. Particularly, the horizontal fold line thereof, which is required to permit the sleeve to be tightened around the article to be packaged, weakens the base portion as well as prevents the surface of the base portion from being completely flat. The weakness introduced into the base portion combines with the resulting irregularity of the surface to reduce the amount of frictional force that can be applied by the base portion to the corresponding bottom surface of the article. Since this frictional force is required to hold the article in place, such fold lines, score lines, or other preformed irregularities introduced into the base portion tend to defeat the purpose of holding the object immobile. It is an outstanding feature of the present invention, therefore, to provide a flat and rigid support portion 18 which maximizes rigidity and frictional article retaining force.

Further, it is also recognized herein that the packaging system does not completely immobilize the article, as movement of the article is permitted to the extent that the sleeve deforms in response to shock. In that regard, it may be desirable to engineer a certain amount of such movement to provide shock absorption, and thereby to controllably dissipate energy through deformation of the sleeve as well as by friction between the article and sleeve, and friction between the article and the support portion. This friction is made more controllable by providing a flat rigid support portion such as the support portion 18. The use of a heat shrinkable sleeve, the deformation of which can be well-controlled as a result of timed application of a controlled heat source, assists further to provide a packaging system having well-controlled shock absorption characteristics.

Figure 7:
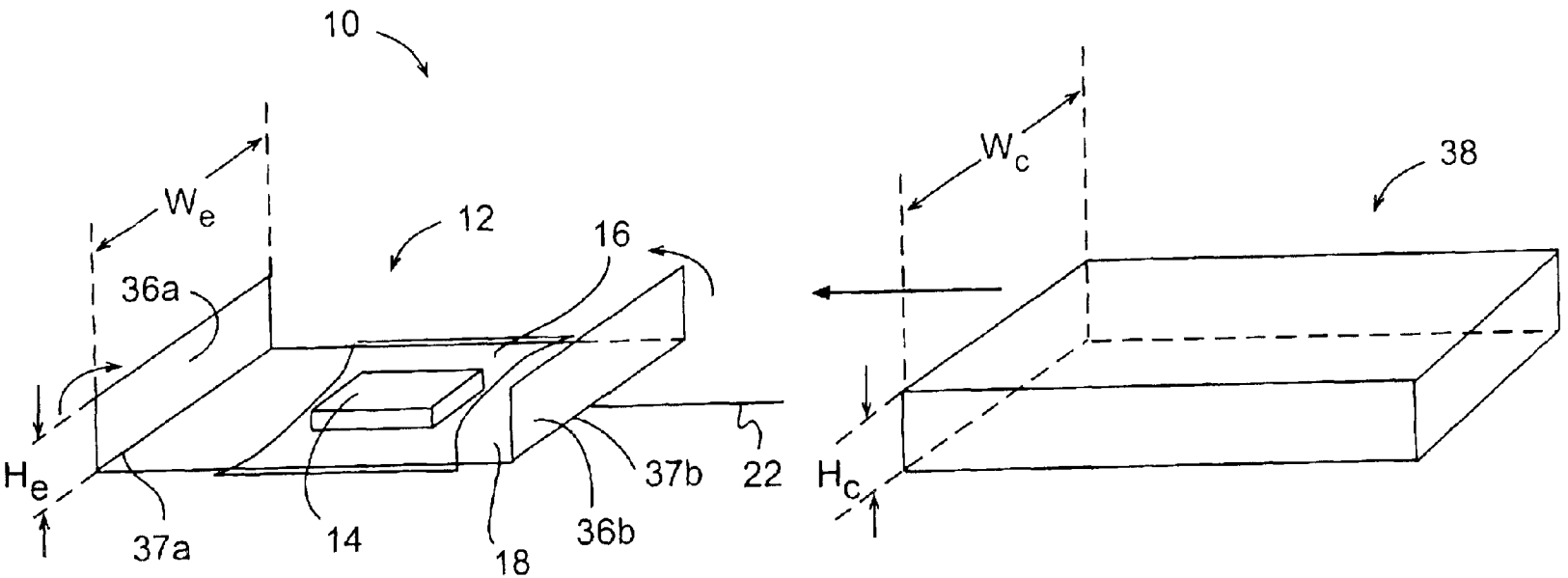
FIG. 7 is a pictorial view of a packaging system according to the present invention comprising a shipping box.

After the sleeve 16 has been heat shrunk around the article 14, such as shown in FIG. 7, the package assembly resulting may be placed inside a shipping container or carton, such as a corrugated paperboard box 38. In addition, preferably, the cradle 12 is provided with end portions 36*a*, 36*b* connecting to respective ends of the supporting portion 18, preferably at corresponding fold lines 37*a*, 37*b*. The end portions 36 are "up-turned" in the direction of the arrows to form flanges having a height $H_e$ and a width $W_e$ that are snugly received in a shipping carton 38 having corresponding dimensions $H_c$ and $W_c$. The upturned end portions 36 thereby provide a means of stabilizing the cradle 12 in the shipping carton.

The article 14 may include additional packaging (not shown), such as by being disposed in a plastic pouch. The additional packaging may be used for added security, such as where the article may leak, or it may be used as a means to change the frictional characteristics of the object with respect to the sleeve or the supporting portion 18 if that is desired.

Figure 8:
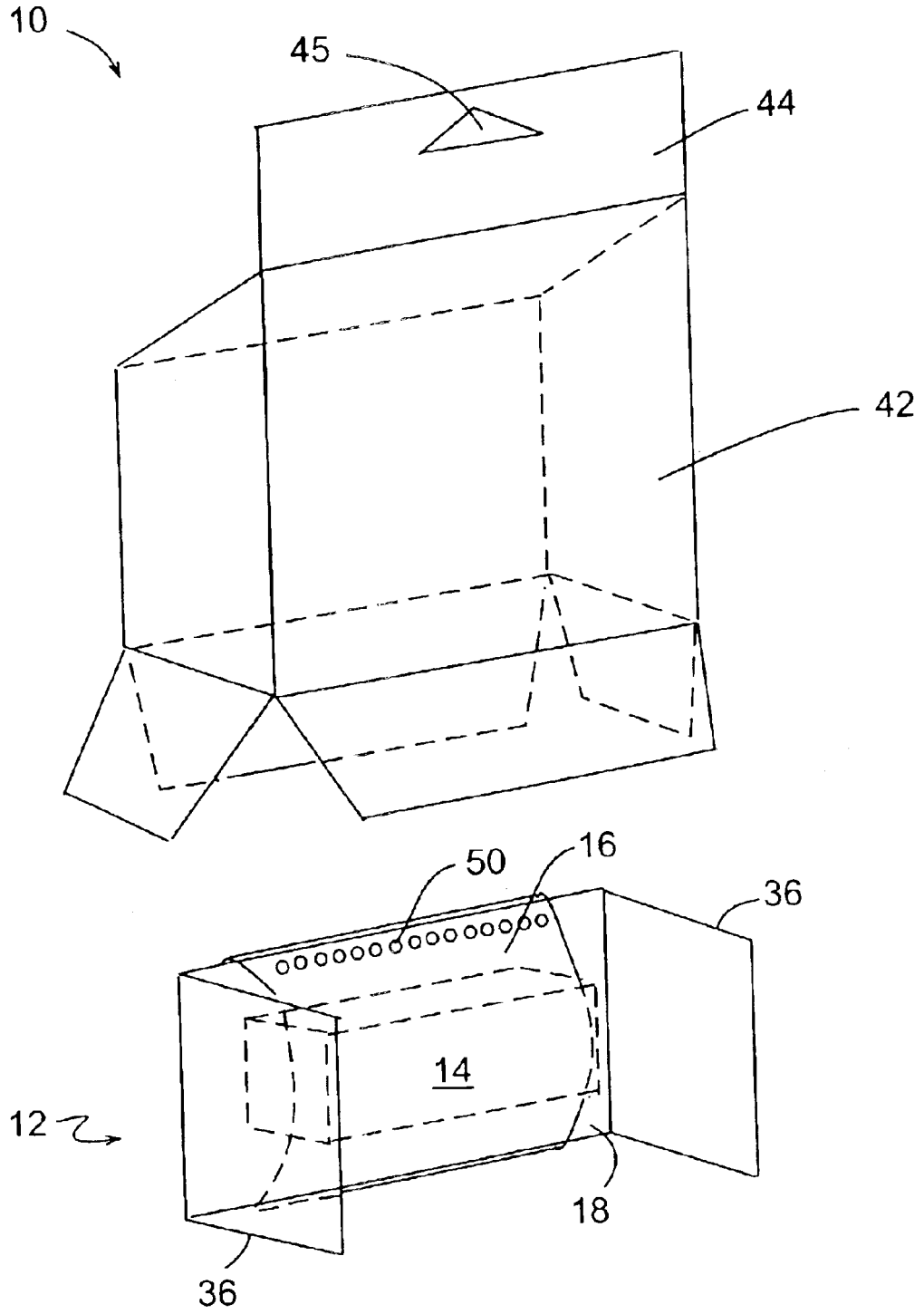
FIG. 8 is a pictorial view of a packaging system according to the present invention comprising a universal presentation box.

Turning to FIG. 8, a presentation carton 42 is shown that may substitute for the shipping carton 38 of FIG. 7. The presentation carton 42 would typically include graphics for point of sale purchase inducement and a top portion 44 having a hole 45 therethrough for hanging on a display. With respect to either of the package assemblies of FIGS. 7 and 8, the cradle 12 may be disposed in the respective carton in any orientation; however, it is has been found to be desirable to ship the cartons so that the support portion 18 is maintained in a vertical plane, which has been found to provide an enhanced degree of shock absorption.

Referring back to FIGS. 1 and 3, to facilitate removal of the article 14 from the cradle 12 by the end user after shipping, one or more lines of perforations or scoring lines 50 are preferably preformed on the plastic sleeve, to facilitate tearing the sleeve.

Since the heat shrinking causes the plastic sleeve to conform to the shape of the article to be packaged, a variety of irregular shaped and sized articles can be shipped using a single packaging system. In addition, a number of cradles can be placed on a rack for heat shrinking at one time further decreasing labor cost. The packaging system is a complete system, and no additional dunnage or other packaging material is required for further article protection.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A packaging system for an article, the article having an article width measured along a first dimension of the article, the system comprising:

a cradle being a flat sheet of corrugated paperboard, said cradle having a cradle width measured along a first dimension of said cradle and two edges spaced apart by said cradle width, said cradle for receiving, on a face thereof, the article such that the first dimension of the article is substantially aligned with said first dimension of said cradle, said cradle width substantially exceeding the article width; and a tubular sleeve defining a tubular axis and surrounding said cradle and the article so that said tubular axis is perpendicular to the first dimension of the article and said cradle, said sleeve being formed of a heat shrinkable material and conforming to an upper periphery of said article and to said two edges such that a said sleeve adopts a substantially trapezoidal shape as viewed along said tubular axis.

2. The packaging system of claim 1, wherein said sleeve adopts a shape substantially conforming to the article width as viewed in a direction perpendicular to said tubular axis and parallel to said face.

3. The packaging system of claim 1, the article having an article length measured in a second dimension of the article that is perpendicular to the first dimension of the article, said cradle having a cradle length measured in a second dimension of said cradle that is perpendicular to said first dimension of said cradle, said cradle length substantially exceeding said article length.

4. The packaging system of claim 3, wherein said sleeve adopts a shape substantially conforming to the article width as viewed in a direction perpendicular to said tubular axis and parallel to said face.

5. The packaging system of claim 1, said cradle having a cradle length measured in a second dimension of said cradle that is perpendicular to said first dimension of said cradle, said tubular sleeve extending a maximum distance measured along said tubular axis, said cradle length substantially exceeding said maximum distance.

6. The packaging system of claim 5, wherein said sleeve adopts a shape substantially conforming to the article width as viewed in a direction perpendicular to said tubular axis and parallel to said face.

7. The packaging system of claim 5, the article having an article length measured in a second dimension of the article that is perpendicular to the first dimension of the article, said cradle length substantially exceeding said article length.

8. The packaging system of claim 7, wherein said sleeve adopts a shape substantially conforming to the article width as viewed in a direction perpendicular to said tubular axis and parallel to said face.

9. The packaging system of claim 8, wherein said sleeve has two opposite ends defining said maximum distance, each of said ends adopting a concave shape as viewed in a direction perpendicular to said tubular axis and perpendicular to said face.

10. The packaging system of claim 7, wherein said sleeve has two opposite ends defining said maximum distance, each of said ends adopting a concave shape as viewed in a direction perpendicular to said tubular axis and perpendicular to said face.

11. The packaging system of claim 6, wherein said sleeve has two opposite ends defining said maximum distance, each of said ends adopting a concave shape as viewed in a direction perpendicular to said tubular axis and perpendicular to said face.

12. The packaging system of claim 5, wherein said sleeve has two opposite ends defining said maximum distance, each of said ends adopting a concave shape as viewed in a direction perpendicular to said tubular axis and perpendicular to said face.

* * * * *